United States Patent [19]

Murphy

[11] 4,246,729

[45] Jan. 27, 1981

[54] SHARPENER FOR SELF-SHARPENING FEED CHOPPING KNIVES

[76] Inventor: Charles J. Murphy, Rte. 1, Abilene, Kans. 67410

[21] Appl. No.: 46,221

[22] Filed: Jun. 7, 1979

[51] Int. Cl.[3] ..... B24B 3/36

[52] U.S. Cl. ..... 51/250

[58] Field of Search ..... 51/250, 246; 76/82.1; 56/250

[56] References Cited

U.S. PATENT DOCUMENTS

| | | | |
|---|---|---|---|
| 2,476,177 | 7/1949 | Bloom et al. | 56/250 |
| 3,059,384 | 10/1962 | McClellan | 51/250 |
| 4,031,670 | 6/1977 | Murphy | 51/250 |

*Primary Examiner*—Othell M. Simpson
*Assistant Examiner*—Roscoe V. Parker
*Attorney, Agent, or Firm*—Edwin H. Crabtree

[57] ABSTRACT

An improved sharpener for self-sharpening feed chopping knives used in cutting crops, forage, ensilage and the like. The sharpener may be lowered on top of the chopping knives so that the knives are continuously sharpened during the cutting operation. The stone may be pivoted out of the chopping box when the knives have been sharpened to prevent a sharpening stone mounted on the sharpener from being exposed to potential breakage from foreign material received inside a chopper box containing the knives mounted on a rotating cutter head.

4 Claims, 3 Drawing Figures

SHARPENER FOR SELF-SHARPENING FEED CHOPPING KNIVES

BACKGROUND OF THE INVENTION

This invention relates to a sharpener for self-sharpening feed chopping knives and the like, and more particularly, but not by way of limitation, to a sharpener having means for pivoting upwardly a sharpening stone and a stone holder housing away from the cutting edge of the chopping knives to prevent potential breakage of the sharpening stone.

This invention relates to an improved structure of an adjustable sharpener for self-sharpening feed chopping knives disclosed in U.S. Pat. No. 4,031,670. The invention described in this patent, while greatly improving the operation of self-sharpening feed chopping knives continuously during the cutting of crops, forage, ensilage and the like, did not include structure to allow the pivoting of the stone holder housing and stone out of the chopper box when the knives had been sharpened. Heretofore the sharpening stone was exposed to potential breakage from foreign material being trapped between the cutting edge of the knives and the sharpening stone as the knives are continuously sharpened during the cutting operation and causing breakage of expensive sharpening stones.

The subject invention eliminates having to expose the sharpening stone mounted in the stone holder housing continuously to the rotating cutter head and chopping knives inside the chopper box.

SUMMARY OF THE INVENTION

The improved sharpener removes the sharpening stone from inside the chopper box when the cutting knives on the rotating cutting head are sharpened thereby eliminating potential breakage of the sharpener stone during the operation of the feed chopping. This invention greatly reduces the cost of replacing broken sharpening stones. The improved sharpener is rugged in construction, simple in design and can be quickly placed in operation on existing feed chopping equipment or new feed chopping equipment so that the feed chopping knives can be sharpened continuously during the cutting operation.

The invention provides not only means for pivoting the sharpening stone and stone holder housing upwardly away from the cutting edge of the chopping knives, but also provides means for raising the entire hinged shield holding the stone holder housing thereon so that access is provided for removing foreign material binding against the feed chopping knives inside the chopper box for performing maintenance on the cutter head.

The improved sharpener for self-sharpening feed chopping knives includes a hinged shield pivotally attached to the top of a chopper box. The shield includes an elongated opening. The length of the opening is disposed above the length of the knives mounted on the rotating cutter head as the knives are rotated thereby. A stone holder housing is hinged to the top of the shield and along one side of the length of the opening in the shield. When the stone housing is pivoted into a lowered position on top of the shield, the stone housing covers the opening in the shield. An elongated sharpener stone mounted in the housing extends through the opening in the shield when the stone holder housing is in a lowered position. When the stone holder housing is pivoted upwardly in a raised position, an access cover which is pivotally attached to the shield and along the opposite side of the opening in the shield, can be lowered to cover the opening when the chopper knives have been sharpened.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
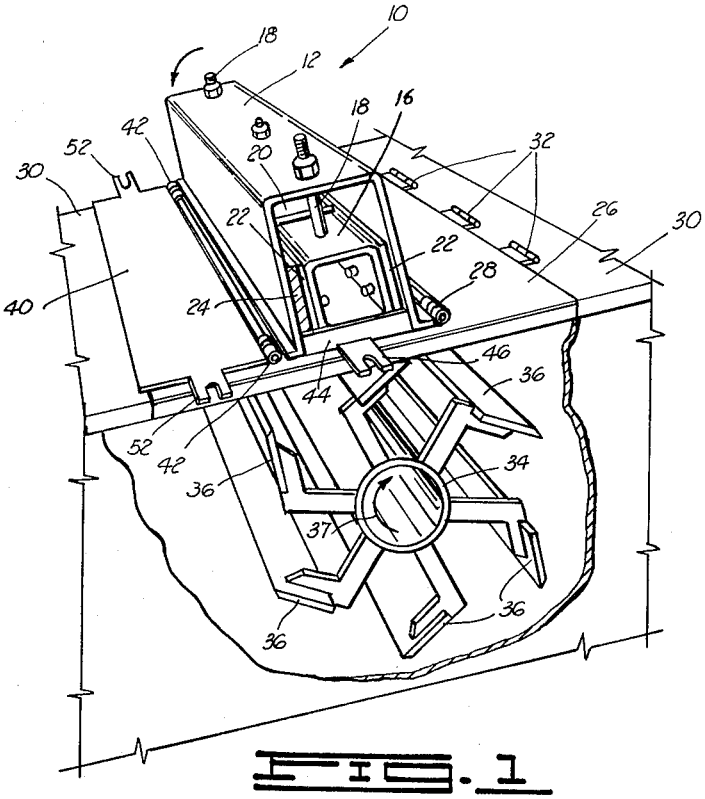
FIG. 1 is a perspective view of the improved sharpener pivotally attached to the top of a chopper box and disposed above a rotating cutter head with chopping knives.

In FIG. 1 the improved sharpener for self-sharpening feed chopping knives is designated by general reference numeral 10. The sharpener 10 includes a "U" shaped stone housing 12 having an elongated sharpening stone 14 mounted inside. An elongated follower 16 is mounted inside the housing 12 and disposed above and on top of the sharpening stone 14. The stone 14 can be seen in FIG. 2 extending outwardly from the open bottom of the housing 12. The follower 16 is attached to the top of the housing 12 by threaded bolts 18. By adjusting the length of the bolts 18 the follower 16 is moved upwardly and downwardly inside the housing 12 thereby controlling the vertical travel of the sharpening stone 14. The follower 16 is biased downwardly on top of the stone 14 by a leaf spring 20 mounted on top of the follower 16.

The sharpening stone 14 is held laterally in a fixed position between two angular shaped holders 22 mounted on both sides of the follower 16 and stone 14. Also mounted on one side of the stone 14 and disposed between one side of the housing 12 and one of the holders 22, is a cutting bar 24. The cutting bar 24 protects the side of the sharpening stone 14 from being hit by foreign objects and material.

The "U" shaped stone housing 12 is pivotally attached to the top of a shield 26 by hinges 28. The shield 26 is pivotally attached to a cutter box 30 by hinges 32. The cutter box 30 surrounds a cutter head 34. The cutter head 34 is rotatably mounted to the sides of the cutter box 30. The cutter box 30 in FIG. 1 has been cut away to expose the cutter head 34 and feed chopping knives 36. Mounted on the cutter head 34 are a plurality of feed chopping knives 36. An arrow 37 indicates the clockwise direction of rotation of the cutter head 34 with the cutting edges of the knives 36 contacting the bottom of the stone 14 so that the cutting edges of the knives 36 are continuously sharpened during the feed chopping operation.

Figure 2:
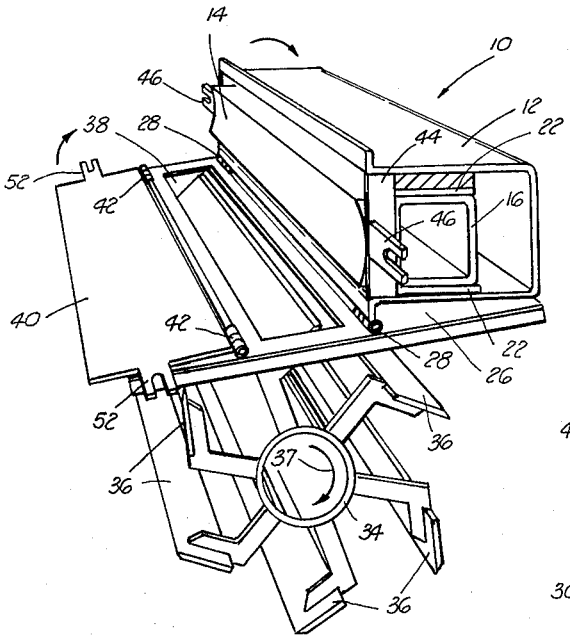
FIG. 2 is a perspective view of the improved adjustable sharpener with a stone holder housing and sharpener stone pivoted upwardly in a raised position.

In FIG. 2 the sharpener 10 is shown characterized by having an opening 38 in the hinged shield 26. The length of the opening 38 is parallel to the length of the knives 36 and disposed directly above the cutting edges of the knives 36 when the knives 36 are in a twelve o'clock position.

When the "U" shaped stone housing 12 and stone 14 are pivoted on hinges 28 into a lowered position, the bottom of the sharpening stone 14 is received through the opening 38 so that the bottom of the sharpening stone 14 is parallel and tangent to the cutting edges of the knives 36.

During the operation of the cutting of crops, ensilage, and the like, the chopping knives 36 are continuously sharpened as the cutter head 34 rotates the knives 36 past the bottom of the sharpening stone 14. In the cutting of ensilage, for example, the "U" shaped housing 12 and cutting stone 14 would be lowered into a position as shown in FIG. 1 for a period of approximately ten minutes. During this time the knives 36 are sharpened. At the end of this time the stone housing 12 and sharpening stone 14 are raised upwardly as shown in FIG. 2 so that the stone 14 is no longer biased against the cutting edges of the knives 36. Also in this position the stone is no longer exposed to potential breakage by foreign material received in the cutter box 30 which could bind between the cutter head 34 and the stone 14 causing breakage of the stone 14. When the "U" shaped stone housing 12 and stone 14 are pivoted upwardly into a raised position, the opening 38 is exposed. The opening 38 is covered by an access cover 40 which is pivotally attached to the shield 26 by hinges 42 disposed along one side of the opening 38 and on the opposite side from the hinges 28 attached to the housing 12. The access cover 40 is then pivoted into a lowered position covering the opening 38, thereby preventing material from escaping through the opening 38 and contacting the stone 14 and housing 12 while in a raised position. Normally in cutting ensilage, the operation would continue for four to five hours before the knives 36 would require sharpening again.

Figure 3:
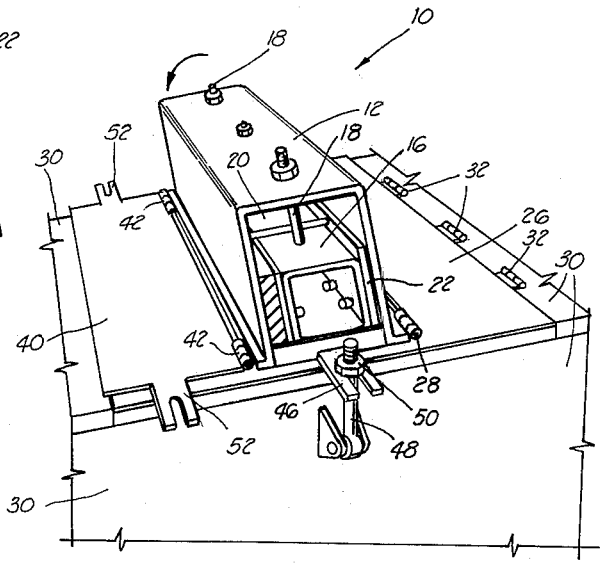
FIG. 3 is a perspective view of the improved sharpener with the stone holder housing secured in a lowered position to the sides of the chopper box.

It should be noted that the "U" shaped housing 12 includes an attachment bar 44 mounted on both ends of the housing 12 and having outwardly extending attachment ears 46. The ears 46 are used for engaging a hinged bolt 48 and threaded nut 50 which are attached on opposite sides of the cutter box 30 as shown in FIG. 3. By securing the sharpener 10 in a lowered position above the opening 38 with the attachment ears 46, the elongated stone 14 and housing 12 are held in a fixed position during the sharpening of the knives 36.

By releasing the bolt 48 and threaded nut 50 from the attachment ears 46, the housing 12 and stone 14 can be pivoted upwardly and the access cover 40 pivoted above the opening 38. The access cover 40 also includes attachment ears 52 extending outwardly from its ends for securing the access cover 40 to the hinged bolt 48 and threaded nut 50 and holding the access cover 38 in a fixed position above the opening 38.

As mentioned above, the shield 26 can be pivoted on hinges 32 attached to the sides of the top of the cutter box 30. When it is desired to perform maintenance on the cutter head 34, or remove foreign material binding inside the cutter box 30, the entire adjustable sharpener 10 mounted on the shield 26 can be raised upwardly on the hinges 32 and ready access is provided for performing maintenance therein.

Changes may be made in the construction and arrangement of the parts or elements of the embodiments as described herein without departing from the spirit or scope of the invention defined in the following claims.

What is claimed is:

1. An improved sharpener for self-sharpening feed chopping knives, the knives mounted on a rotating cutter head disposed inside a chopper box, the improvement comprising:

a shield pivotally attached to the top of the chopper box, the shield having an elongated opening therein, the length of the opening disposed above the length of the knives as the knives are rotated thereby, the shield pivotally attached so that it can be raised above the cutter head in the chopper box and foreign material removed from around the cutter head and maintenance performed thereon;

a stone holder housing hinged to the top of the shield and along the length of one side of the opening, the stone holder housing, when pivoted downwardly into a lowered position on top of the shield, covering the opening;

an elongated sharpening stone mounted in the stone holder housing, the stone extending through the opening in the shield and disposed adjacent the length of the cutting edge of the knives and tangent thereto when the stone holder housing is in a lowered position on top of the shield, the stone holder housing when pivoted upwardly above the top of the shield into a raised position, pivots the stone upwardly away from the cutting edge of the knives to prevent the sharpening thereof; and an access cover hinged to the top of the shield and along the length of the opposite side of the opening in the shield, the access cover when pivoted downwardly covers the opening in the top of the shield when the stone holder housing is in a raised position.

2. The improved sharpener as described in claim 1 further including securing means attached to the ends of the stone holder housing and the sides of the chopper box for securing the stone holder housing in a fixed position when the stone holder housing is in a lowered position on top of the shield.

3. The improved sharpener as described in claim 1 further including securing means attached to the ends of the access cover and the sides of the chopper box for securing the access cover in a fixed position when the cover is in a lowered position on top of the opening.

4. An improved sharpener for self-sharpening feed chopping knives, the knives mounted on a rotating cutter head disposed inside a chopper box, the improvement comprising:

a shield hinged to the top of the chopper box, the shield having an elongated opening, the length of the opening disposed above the length of the knives as the knives are rotated thereby;

a stone holder housing hinged to the top of the shield and along the length of one side of the opening, the stone holder housing, when pivoted downwardly into a lowered position, covering the opening;

an elongated sharpening stone mounted in the stone holder housing, the stone extending through the opening in the shield and disposed adjacent the length of the cutting edge of the knives and tangent thereto when the stone holder housing is in a lowered position on top of the shield;

an access cover hinged to the top of the shield and along the length of the opposite side of the opening, the access cover, when pivoted downwardly, covering the opening in the shield when the stone holder housing is in a raised position above the shield; and securing means attached to the ends of the access cover, the ends of the stone holder housing and the sides of the chopper box for holding the stone holder housing and access cover in a fixed position when they cover the opening in the shield.

* * * * *